US011607043B2

(12) United States Patent
Zhu

(10) Patent No.: US 11,607,043 B2
(45) **Date of Patent: *Mar. 21, 2023**

(54) ROCKER CHAIR

(71) Applicant: MAXTON ENGINEERING LTD., Wan Chai (HK)

(72) Inventor: Shou Qiang Zhu, Wan Chai (HK)

(73) Assignee: MAXTON ENGINEERING LTD., Wan Chai (HK)

( * ) Notice: Subject to any disclaimer, the term of this patent is extended or adjusted under 35 U.S.C. 154(b) by 0 days.

This patent is subject to a terminal disclaimer.

(21) Appl. No.: 17/525,806

(22) Filed: Nov. 12, 2021

(65) Prior Publication Data

US 2022/0175141 A1 Jun. 9, 2022

Related U.S. Application Data

(63) Continuation of application No. 16/843,835, filed on Apr. 8, 2020, now Pat. No. 11,172,762.

(60) Provisional application No. 62/831,614, filed on Apr. 9, 2019.

(51) Int. Cl.
*A47C 3/021* (2006.01)
*A47C 4/28* (2006.01)

(52) U.S. Cl.
CPC ..... *A47C 3/021* (2013.01); *A47C 4/283* (2013.01)

(58) Field of Classification Search
CPC ..... A47C 4/283; A47C 3/021; A47C 3/025
USPC ..... 297/259.4, 264.1, 268.1
See application file for complete search history.

(56) References Cited

U.S. PATENT DOCUMENTS 2,273,980 A * 2/1942 Moody ..... A47C 3/021 297/287
2019/0313799 A1* 10/2019 Frankel ..... A47C 4/283

* cited by examiner

*Primary Examiner* — Sarah B McPartlin
(74) *Attorney, Agent, or Firm* — Liu & Liu

(57) ABSTRACT

A rocker chair having a frame and a longitudinal spring member extending from the frame, at or near a surface on which the chair is supported for rocking motion. The spring member includes an anchored portion anchored to the frame, and an extended portion extending from the anchored portion and is free to flex or bend against spring bias of the extended portion, wherein the extended portion is bendable upward from the support surface against spring bias of the extended portion. The frame of the rocker chair may be collapsible to convert from a collapsed configuration for stowing, to an extended configuration for seating a person. The spring member may include an anchored portion anchored to at least a portion of a bottom of the frame, and an extended portion extending from the anchored portion, wherein the extended portion is bendable against spring bias of the extended portion.

20 Claims, 19 Drawing Sheets

ROCKER CHAIR

This application is a Continuation of U.S. application Ser. No. 16/843,835, filed on Apr. 8, 2020, which claims the priority of U.S. Provisional Patent Application No. 62/831,614 filed on Apr. 9, 2019. This application is fully incorporated by reference as if fully set forth herein. All publications noted below are fully incorporated by reference as if fully set forth herein.

BACKGROUND OF THE INVENTION

1. Field of the Invention

The present invention is directed to rocker chairs, and in particular a rocker chair that allowing for forward and backward rocking motions and adapted to be folded/collapsed for transportation and storage.

2. Description of Related Art

Collapsible or folding chairs are well known in the art. They offer the convenience and comfort for sitting at locations normally without sitting equipment, e.g., at sporting events, outdoor concerts, golf courses, fishing piers, field trips, camp sites, beaches, etc. They also offer the convenience for easy transportation and storage.

To provide additional options for a user, U.S. Pat. Nos. 9,060,611 and 9,282,824 purportedly disclose a collapsible and portable 'rocking' chair. The disclosure of which in their entirety are incorporated herein by reference. The structure of the disclosed 'rocking' chair is rather complex, requiring the entire frame of the chair to be supported by a pair of fixed fulcrum points and at least a separate rocking mechanism in the form of a strut having a tubular member pressing against a spring in a sleeve, which add to structural complexity and manufacturing costs. Further, the strut adds weight, which is not beneficial for a portable chair. In use, the chair frame pivots about the fixed fulcrum points, resulting in the chair frame swinging forward and backwards about the fixed fulcrum points.

It is questionable whether such pivoted chair provides true rocking function based on pivoting of the chair frame about the pair of fulcrum points, and hence it would not be associated with the attributes, feel, and benefits of rocking motion of a true rocking chair. It appears such chair should be more appropriately characterized as a pivoting chair as opposed to a rocking chair. Further, with the weight of the user seated in the pivoting chair frame, the load imparts significant stress upon the fixed fulcrum points, which could place in question the integrity of the fixed fulcrum points to reliably provide pivoting of the chair frame.

It is therefore desirable to design a new and improved rocking or rocker chair with a more reliable and simplified structure, and further a collapsible rocker chair with such reliable and simplified structure.

SUMMARY OF THE INVENTION

The present invention provides a rocker chair with a simplified and reliable structure for rocking motion, which overcomes the drawbacks of the prior art.

The present invention is directed to a rocker chair, which comprises a frame and a longitudinal spring member extending from the frame, at or near a surface on which the chair is supported for rocking motion. The spring member comprises an attached portion anchored or attached to the frame, and an extended portion extending from the attached portion, with at least a flex section of a material having a compliant spring characteristic, which is free to flex or bend against spring bias of the extended portion, wherein the extended portion is bendable at the flex section upward away from the support surface against spring bias of the extended portion.

In one embodiment, the frame (collapsible or otherwise) of the rocker chair supports a flexible seat (e.g., made of a fabric material, such as canvas, polymer/plastic, etc.) defining support/seating surfaces including a seat portion and a seatback portion.

In one embodiment, the longitudinal spring member comprises an attached portion in the form of an anchored portion anchored/attached to at least a portion of a bottom of the frame, and an extended portion extending from the anchored portion with a lateral spacing between the extended portion and the bottom of the frame in an unbiased state of the spring member, wherein the extended portion is bendable at the flex section towards the frame against spring bias of the extended portion.

In one embodiment, the chair frame comprises a pair of side frame members including a first side frame member and a second side frame member; and a connecting frame connecting the first and second side frame members.

In one embodiment, the first and second side frame members of the chair each includes a bottom frame portion having a horizontal portion and an angled portion. The anchored portion of each longitudinal spring member is fixedly attached to the horizontal portion of the bottom frame portion, and the extended portion of the longitudinal spring member extends from the anchored portion with a lateral spacing from the angled portion of the bottom frame portion in an unbiased state of the spring member. The horizontal portion is towards the front of the chair, and the extended portion of the spring member extends towards the rear of the chair. In effect, the longitudinal spring member is attached in a cantilevered manner, with the anchored portion fixedly attached to the horizontal portion of the bottom frame portion, and the flex section of the extended portion extending from the anchored portion/horizontal portion in a cantilevered manner, so that the spring member extends with a spacing from the angled portion of the bottom frame portion.

In use, the spring member rests on a support surface for the chair (e.g., ground, a floor, sports field, etc.), with the horizontal portion of the bottom frame portion above the anchored portion of the spring member. A user sitting in the chair can lean backward to place more weight towards the rear of the seat, thereby flexing the flex section of the extended portion of the spring member with respect to the anchored portion of the spring member. More specifically, the bottom frame portion includes a curved portion at a joint between the horizontal portion and the angled portion, and wherein when the curved portion rolls over the flex section of the extended portion of the spring member, the flex section bends to form a curved configuration, and the horizontal portion and the attached anchored portion of the spring member together tilts upwards lifting from the support surface. As a result, the chair tilts backwards in this configuration, with the extended portion of the spring member flexing towards the angled portion of the bottom frame portion creating a spring bias under the user's weight on the chair. As the user shifts his/her weight forward, the spring bias tilts the chair from the backwards tilt configuration. The user can thus rock the chair by shifting/leaning his/her weight forward and backward to achieve a rocking motion.

In one embodiment, the longitudinal spring member is in the form of a strip or bar having at least a section (i.e., the flex section) made of a material having a firm, but relatively stiff, but cyclically flexible/pliant spring characteristic. Suitable materials for the spring member may include fiberglass, wood, laminated wood, plastic, polymer, carbon polymer, carbon fiber, metal alloy, wood and polymer composite, metal and wood composite, etc. In one embodiment, the material for the spring member is preferably fiberglass. In another embodiment, the flex section extends along substantially entire longitudinal length of the spring member (i.e., the entire length of the spring member is a substantially uniform, unitary and/or monolithic member, except for the guide bracket attached at the end of the spring member as discussed below).

In one embodiment, the anchored portion of the spring member is securely and fixedly attached to the horizontal portion of the bottom frame portion by bolts and nuts. Alternatively, and/or in addition, the anchored portion may be fixedly attached to the horizontal portion by rivets, screws, clamps, epoxy, bonding, welding, brazing, and other means of attachment, depending on the material of the spring member.

In one embodiment, the end of the extended portion of the spring member is a free end.

In another embodiment, the end of the spring member is provided with a guide bracket to maintain the lateral position of the spring member. The end of the spring member is provided with a guide bracket that is slidably coupled to the frame, wherein the guide bracket maintains the lateral position of the spring member. In an embodiment, each of the first and second side frame members of the chair frame has a rear frame portion extending from the angled portion of the bottom frame portion towards a seatback of the chair, and the guide bracket is slidably coupled to the bottom end of the rear frame portion. In one embodiment, the guide bracket has an upwardly extending guide portion having a vertical slot, through which a guide pin extending at the bottom end of the rear frame portion is slidably coupled.

In another embodiment, the rear frame portion of each of the first and second side frame members of the chair frame includes a branch portion extending downwards to the end of the extended portion of the spring member, and the guide bracket is slidably coupled to the depending end of the branch portion, e.g., in a similar manner as the previous embodiment (i.e., slot and guide pin coupling).

In one embodiment, the guide bracket is pivotally attached to the end of the spring member.

In a further embodiment of the present invention, it is directed to rocker chair that is collapsible (or foldable), which can be collapsed to a compact form for stowing or transportation. The collapsible rocker chair comprises a collapsible frame structured to convert from a collapsed configuration for stowing/transportation, to an extended configuration for seating a person, wherein in the collapsed configuration, the frame is folded to collapse the frame into a compact form, wherein in the extended configuration, the frame is unfolded to extend support surfaces for the person's back and buttock. The simple spring member structure of the present invention provides a light weight structure that is particularly beneficial to a portable, collapsible rocking chair.

In one embodiment, the frame of the rocker chair comprises first and second side frame members, the connecting frame includes a pair of connecting members connecting the first and second side frame members, and the pair of connecting members can be configured between the extended configuration in which the first and second side frame members are spaced apart, and the collapsed configuration in which the first side frame member is brought close to the second side frame member to collapse the frame. In another embodiment, each connecting member comprises a scissor hinge structure pivotally interconnecting between the first and second side frame members.

In various embodiments, the inventive rocker chair is substantially as described and illustrated.

BRIEF DESCRIPTION OF THE DRAWINGS

For a fuller understanding of the nature and advantages of the invention, as well as the preferred mode of use, reference should be made to the following detailed description read in conjunction with the accompanying drawings. In the following drawings, like reference numerals designate like or similar parts throughout the drawings.

DETAILED DESCRIPTION OF THE INVENTION

This inventive concept is described below in reference to a collapsible rocker chair, and further in reference to various embodiments thereof with reference to the figures. While this invention is described in terms of the best mode for achieving this invention's objectives, it will be appreciated by those skilled in the art that variations may be accomplished in view of these teachings without deviating from the spirit or scope of the invention. The inventive structure that provides the rocking motion may be implemented in a non-collapsible rocker, or a collapsible rocker that collapses in a different manner, without departing from the scope and spirit of the present invention.

Embodiment A

Figure 1:
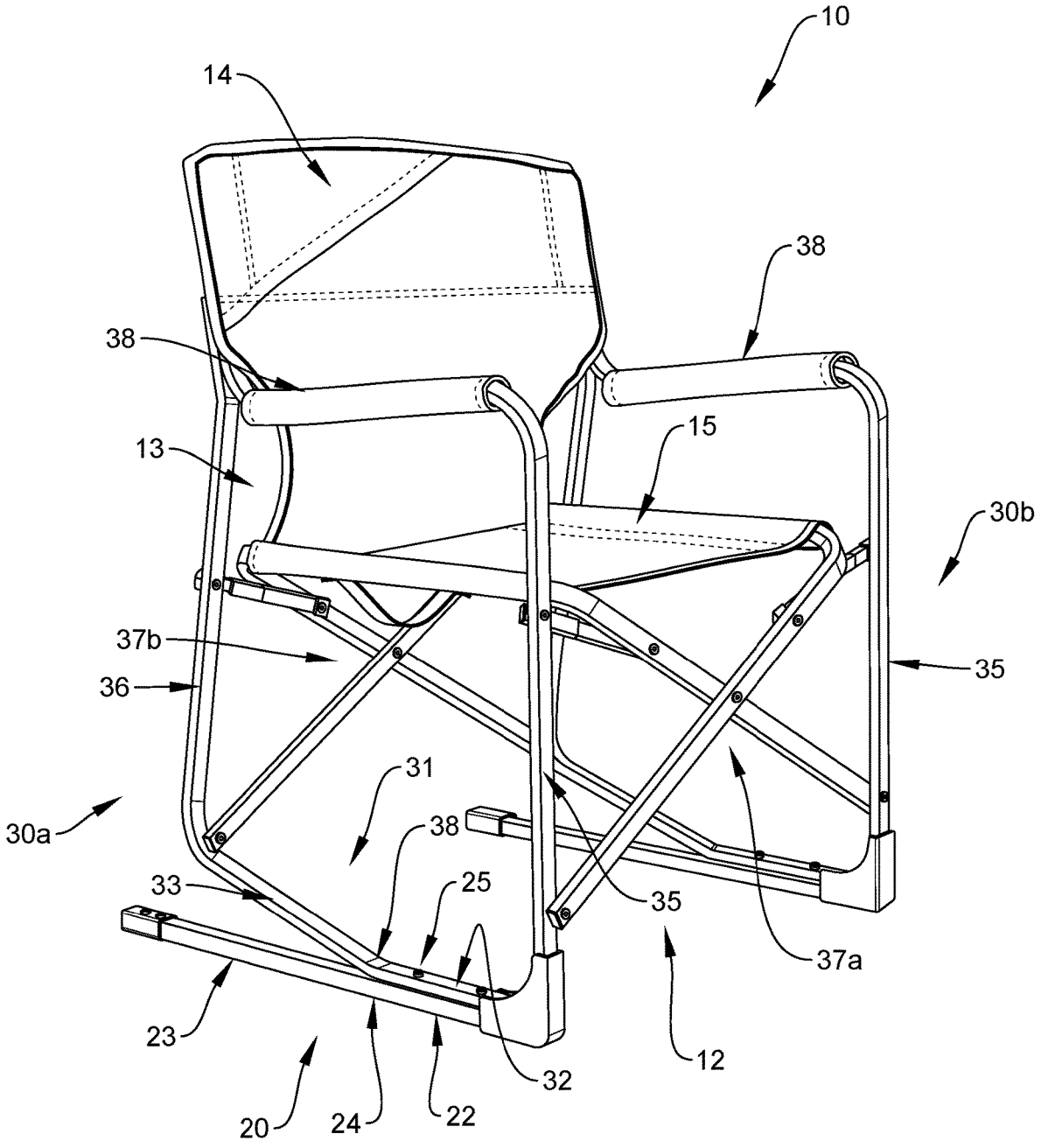
FIGS. 1 to 7 illustrate a collapsible rocker in a fully unfolded extended configuration in accordance with one embodiment of the present invention.
Figure 2:
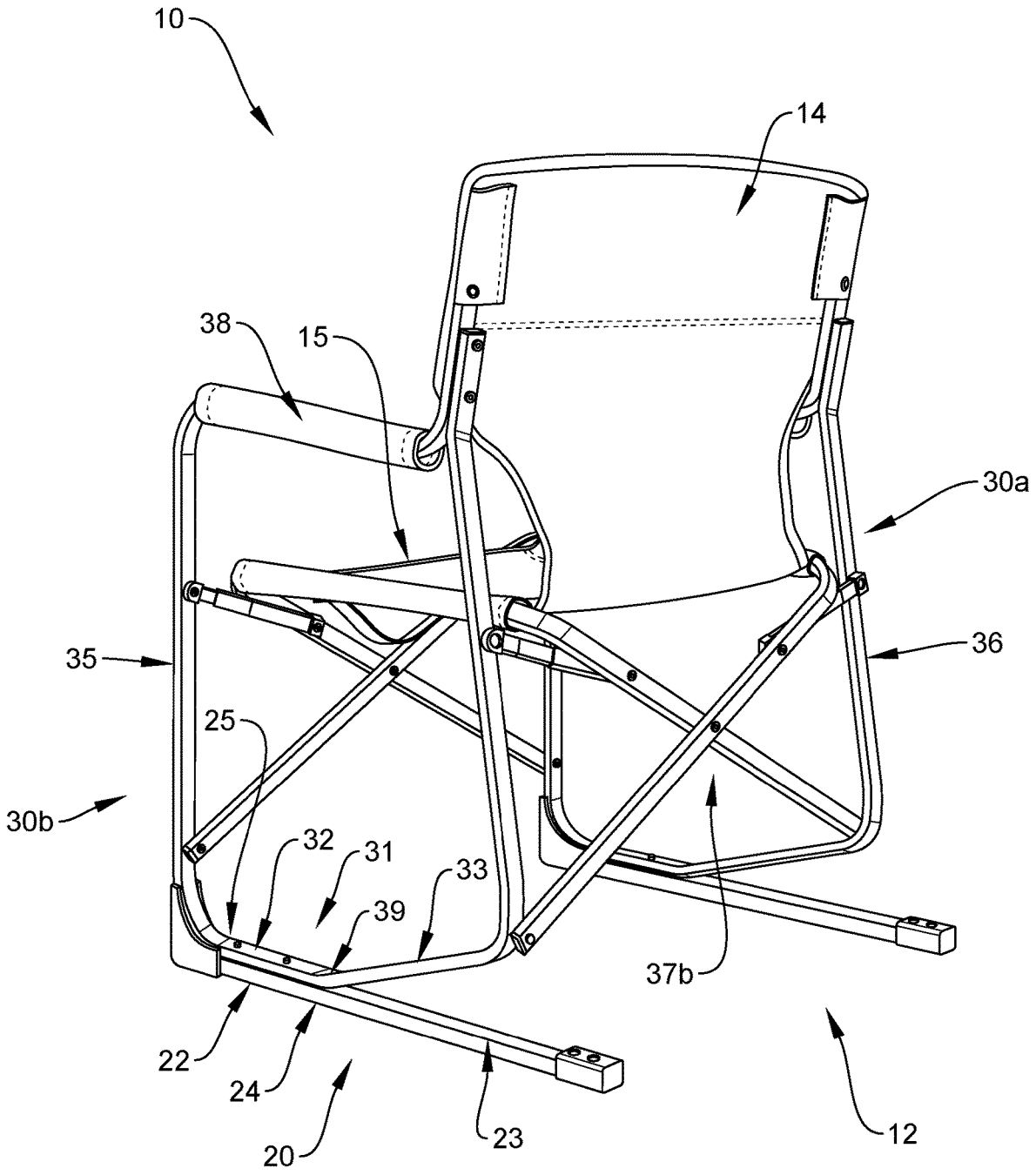
Figure 3:
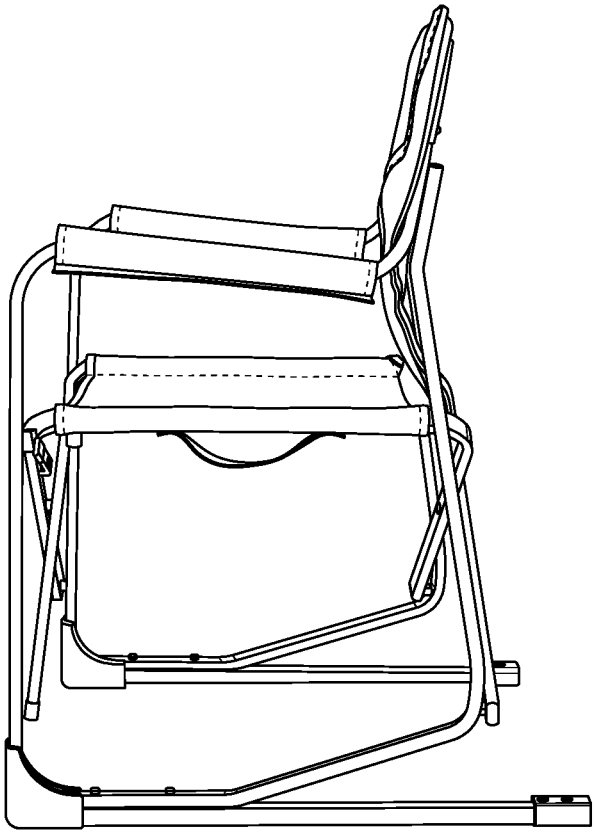
Figure 4:
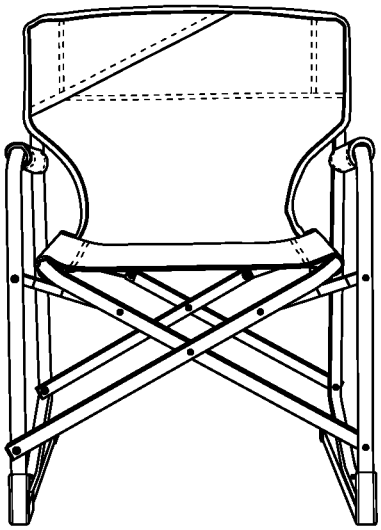
Figure 5:
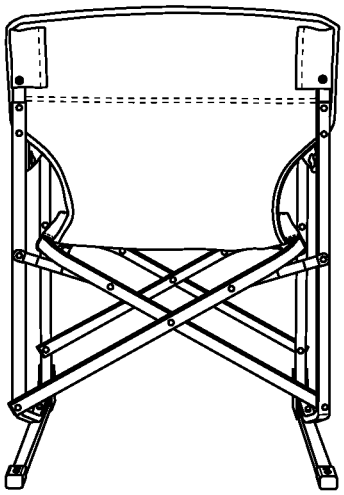
Figure 6:
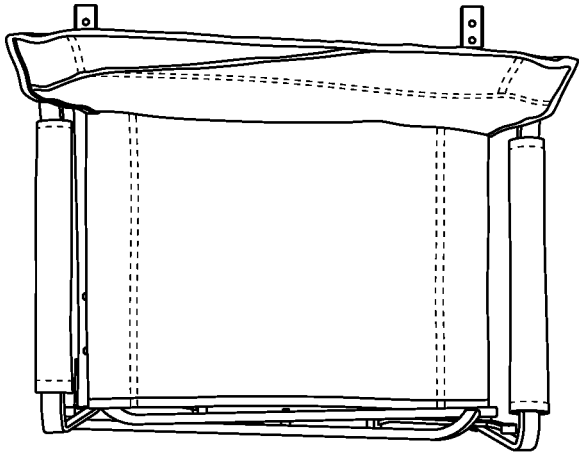
Figure 7:
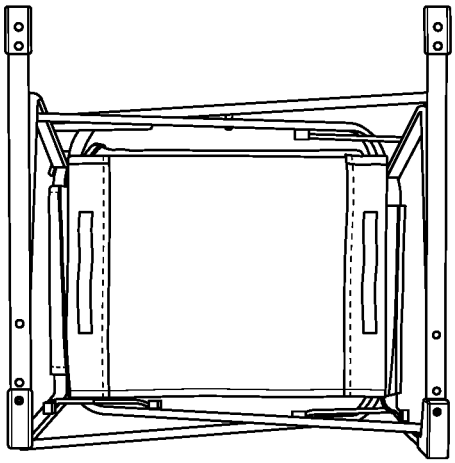
Figure 8:
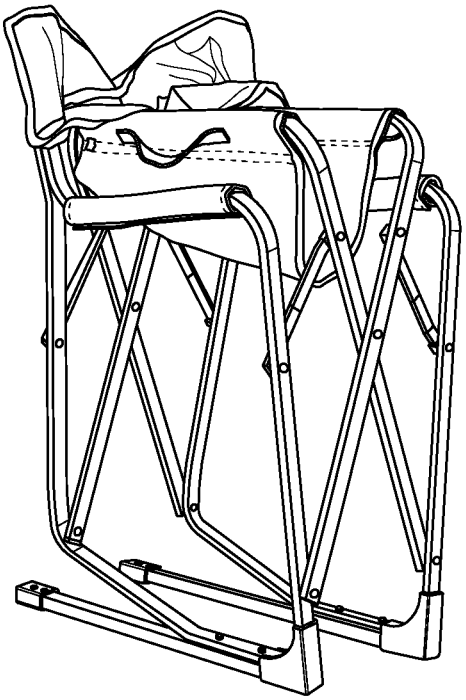
FIG. 8 illustrates the collapsible rocker in a collapsed/folded configuration in accordance with one embodiment of the present invention.

FIGS. 1 to 7 illustrate a collapsible rocker 10 in a fully unfolded extended configuration in accordance with one embodiment of the present invention. FIG. 8 illustrates the collapsible rocker 10 in a collapsed/folded configuration in accordance with one embodiment of the present invention.

As illustrated, the rocker chair comprises a collapsible chair frame 12 structured to convert from a collapsed configuration (FIG. 8) for stowing/transportation, to an extended configuration (FIGS. 1-7) for seating a person, wherein in the collapsed configuration, the frame 12 is folded to collapse the frame 12 into a compact form, wherein in the extended configuration, the frame 12 is unfolded to extend support/seating surfaces (14, 15)) for the person's back and buttock; and a longitudinal spring member 20 including an anchored portion 22 anchored/attached to a horizontal portion 32 of the bottom frame portion 31 of the chair frame 12, and an extended portion 23 extending from the anchored portion 22 with a lateral spacing between the extended portion 23 and an angled portion 33 of the bottom frame portion 31 of the frame 12 in an unbiased state of the spring member, wherein the extended portion 23 is bendable towards the angled portion 33 against spring bias of the extended portion 23. In particular, the extended portion comprises at least a flex section 24 of a material having a pliant spring characteristic, and wherein the extended portion is free to flex against spring bias of the flex section of the extended portion As illustrated, the chair frame 12 supports a flexible seat 13 (e.g., made of a fabric material, such as canvas, polymer/plastic, etc.) defining support/seating surfaces including a seat portion 15 and a seatback portion 14. In one embodiment, the chair frame 12 comprises a pair of side frame members 30 including a first side frame member 30*a* and a second side frame member 30*b*; a pair of connecting members (37*a*, 37*b*) pivotally connecting the first and second side frame members (30*a*, 30*b*), wherein the pair of connecting members (37*a*, 37*b*) can be configured between the extended configuration in which the first and second side frame members (30*a*, 30*b*) are spaced apart, and the collapsed configuration in which the first side frame member 30*a* is brought close to the second side frame member 30*b* to collapse the frame 12.

In one embodiment, the first and second side frame members (30*a*, 30*b*) of the chair frame 12 each includes a bottom frame portion 31 having a horizontal portion 32 and an angled portion 33, a front frame portion 35, a rear frame portion 36, and handle portion 38. Each connecting member (37*a*, 37*b*) comprises a scissor hinge structure pivotally interconnecting between the front frame portions 35 and rear frame portions 36 of the first and second side frame members (30*a*, 30*b*). The anchored portion 22 of each longitudinal spring member 20 is fixedly attached to the horizontal portion 32 of a bottom frame portion 30, and the extended portion 23 of the longitudinal spring member 20 extends from the anchored portion 22 with a lateral spacing from the angled portion 33 of the bottom frame portion 31 in an unbiased state of the spring member 20. The horizontal portion 32 is towards the front of the chair 10, and the extended portion 22 of the spring member 20 extends towards the rear of the chair 10. In effect, the longitudinal spring member 20 is attached in a cantilevered manner, with the anchored portion 22 fixedly attached to the horizontal portion 32 of the bottom frame portion 31, and the extended portion 23 extending with a spacing from the angled portion 33 of the bottom frame portion 31, and with the flex section 24 cantilevered from the anchored portion 22/horizontal portion 32.

Figure 9A:
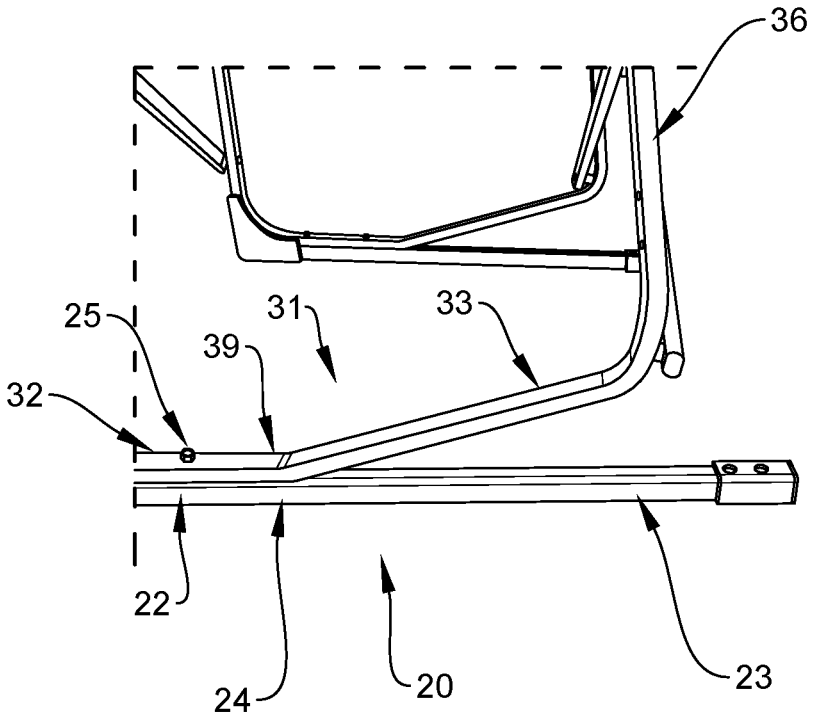
FIGS. 9A and 9B illustrate the relationship of the spring member and the bottom frame portion in a normal upright state of the rocker chair.
Figure 9B:
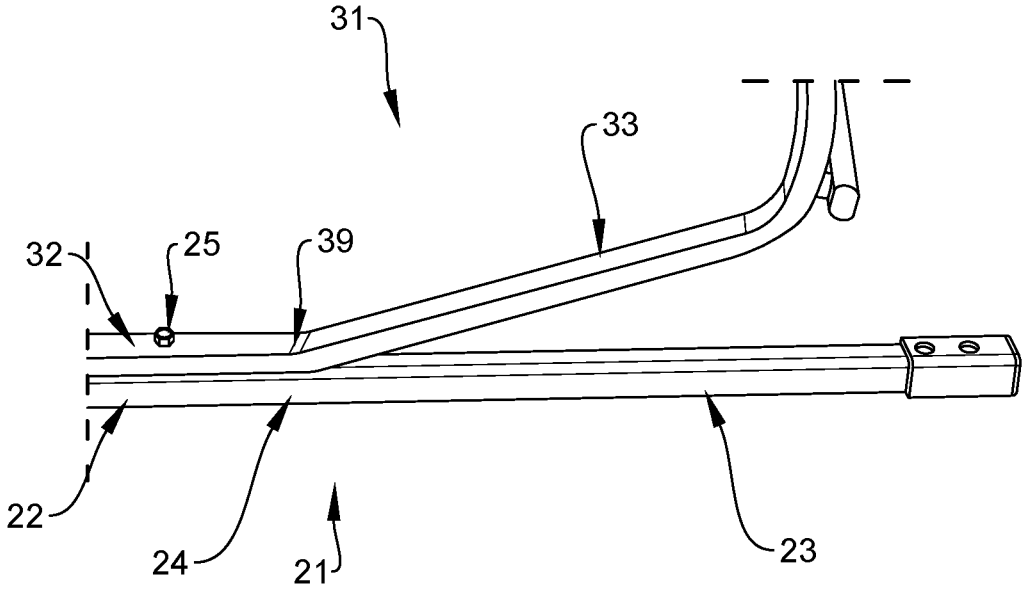

FIGS. 9A and 9B illustrate the relationship of the spring member and the bottom frame portion in a normal upright state of the rocker chair. In use, in the unfolded/extended configuration of the chair frame 12, the spring member 20 rests on a support surface for the chair (e.g., ground, a floor, sports field, etc.), with the horizontal portion 32 of the bottom frame portion 31 above the anchored portion 22 of the spring member 20.

Figure 10A:
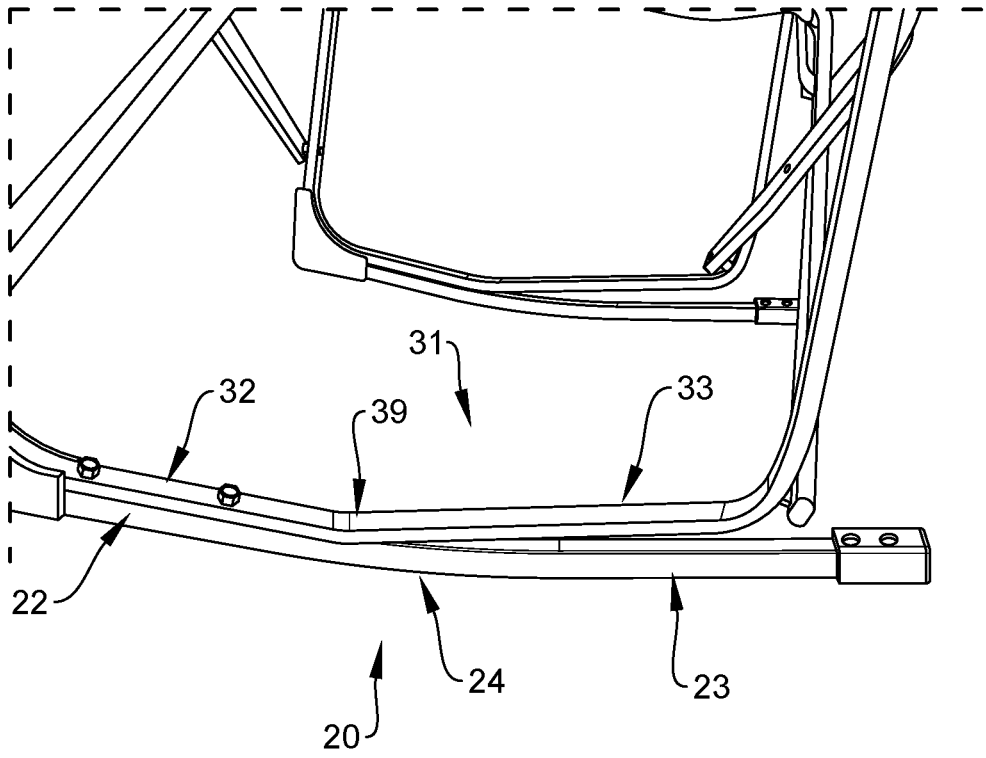
FIGS. 10A and 10B illustrate the relationship of the spring member and the bottom frame portion as the rocker chair rocks backwards.
Figure 10B:
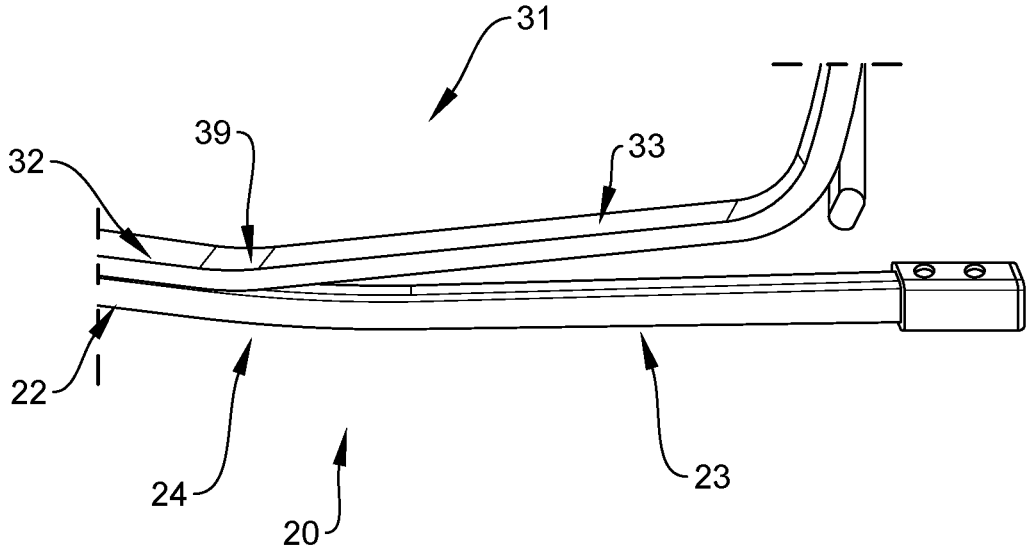
Figure 11:
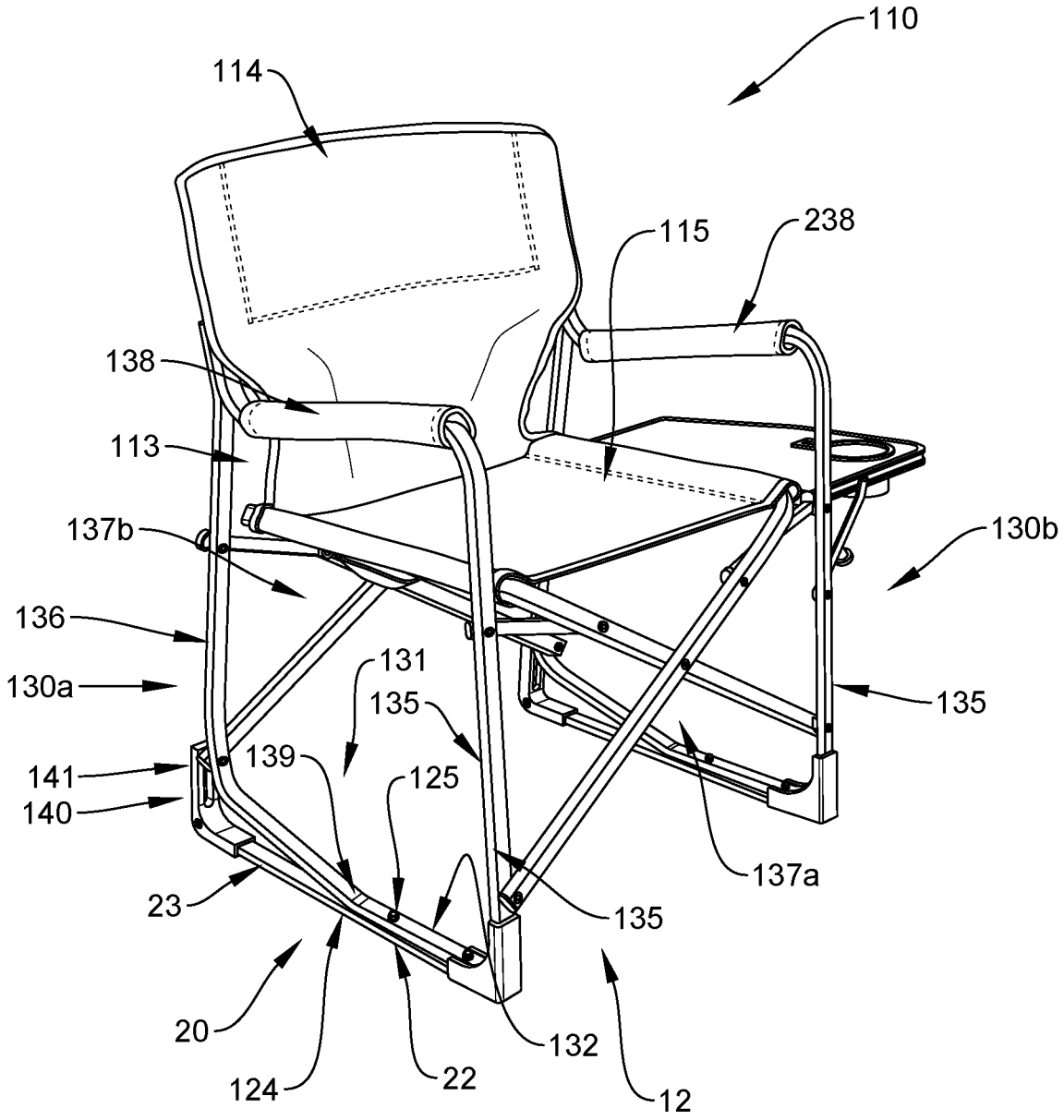
FIGS. 11 to 17 illustrate a collapsible rocker in a fully unfolded extended configuration in accordance with another embodiment of the present invention.
Figure 12:
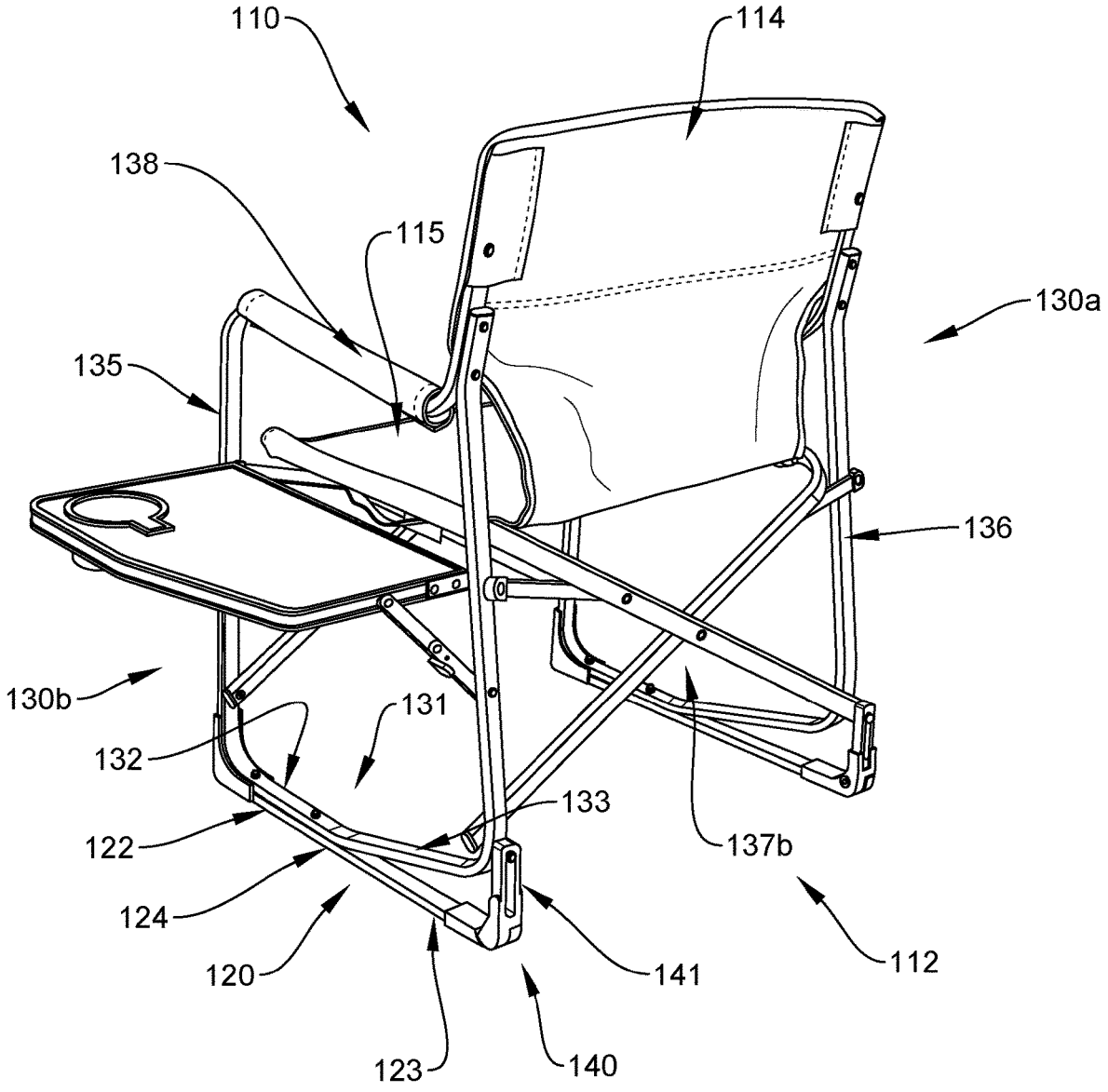
Figure 13:
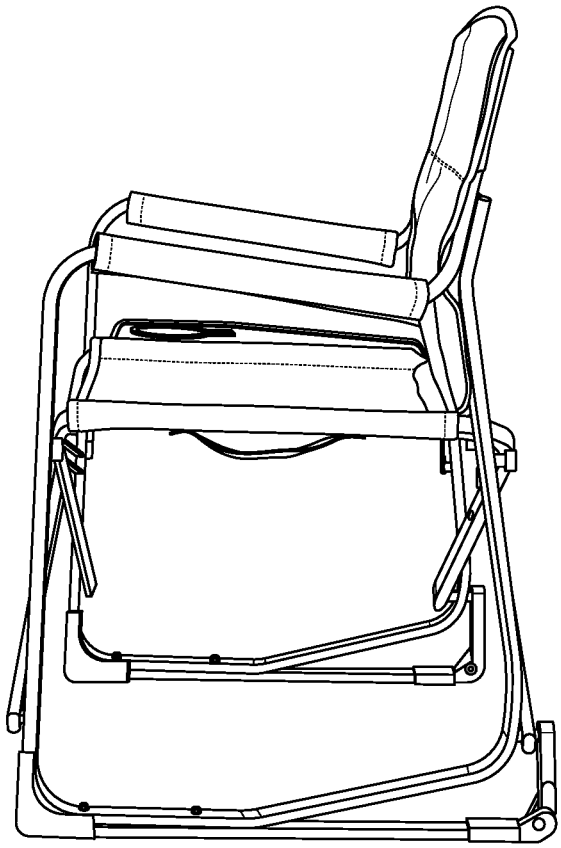
Figure 14:
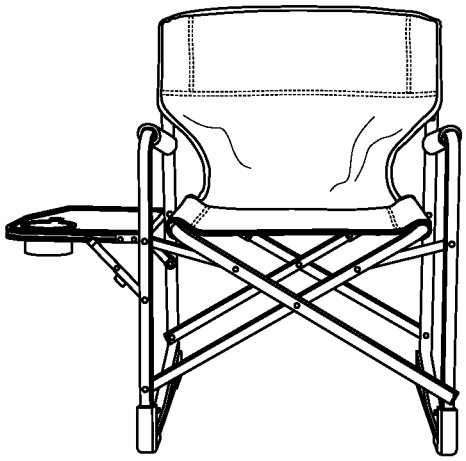
Figure 15:
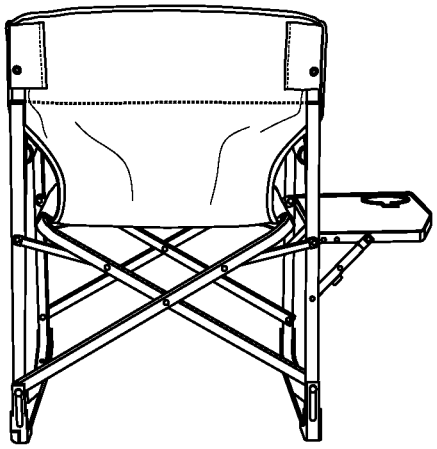
Figure 16:
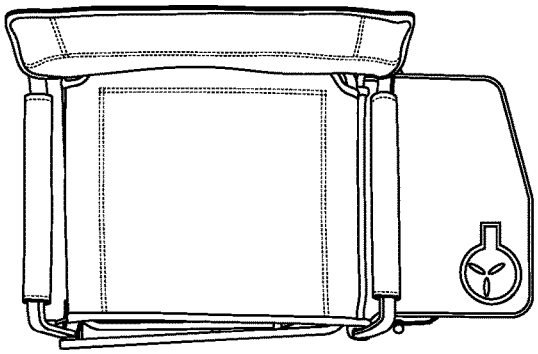
Figure 17:
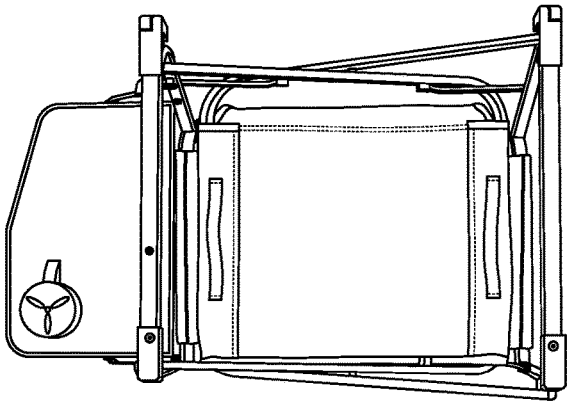

FIGS. 10A and 10B illustrate the relationship of the spring member and the bottom frame portion as the rocker chair rocks backwards. A user sitting in the chair can lean backward to place more weight towards the rear of the seat, thereby flexing the extended portion 23 of the spring member 20 with respect to the anchored portion 22 of the spring member 20. More specifically, the joint 39 between the horizontal portion 32 and the angled portion 33 of the bottom frame portion 31. This curved joint 39 at the bottom frame portion 31 rolls over the flex section 24 of the unattached extended portion 23 of the spring member 20. Further, the flex section 24 of the extended portion 23 of the spring member 20 forms a curved structure. The horizontal portion 32 of the bottom frame portion 31 and the attached anchor portion 22 of the spring member 20 together tilt upwards lifting from the ground. As a result, the chair tilts backwards in this configuration. As a result, the extended portion 23 of the spring member 20 flexing towards the angled portion 33 of the bottom frame portion 31 creates a spring bias under the user's weight on the chair 10. As the user shifts his/her weight forward, the spring bias tilts the chair frame 12 from the backward tilt configuration. The user can thus rock the chair 10 by shifting/leaning his/her weight forward and backward to achieve a rocking motion.

In one embodiment, the longitudinal spring member 20 is in the form of a strip or bar having at least a section (i.e., the flex section 24) of material having a firm, relatively stiff, but cyclically flexible/pliant spring characteristic. Suitable materials for the spring member 20 may include fiberglass, wood, laminated wood, plastic, polymer, carbon polymer, carbon fiber, metal alloy, wood and polymer composite, metal and wood composite, etc. In one embodiment, the material for the spring member 20 is preferably fiberglass.

In another embodiment, the flex section 24 extends along substantially entire longitudinal length of the spring member, including the anchored portion 22 and all of the extended portion 23 (i.e., the entire length of the spring member is a substantially uniform, unitary and/or monolithic member, except for the guide bracket attached at the end of the spring member as discussed below).

In one embodiment, the anchored portion 22 of the spring member 20 is securely and fixedly attached to the horizontal portion 32 of the bottom frame portion 31 by bolts and nuts 25. Alternatively, and/or in addition, the anchored portion 22 may be fixedly attached to the horizontal portion 32 by rivets, screws, clamps, epoxy, bonding, welding, brazing, and other means of attachment, depending on the material of the spring member 20.

In the embodiment illustrated in FIGS. 1-10, the end of the extended portion of the spring member is a free end.

Embodiment B

Figure 18:
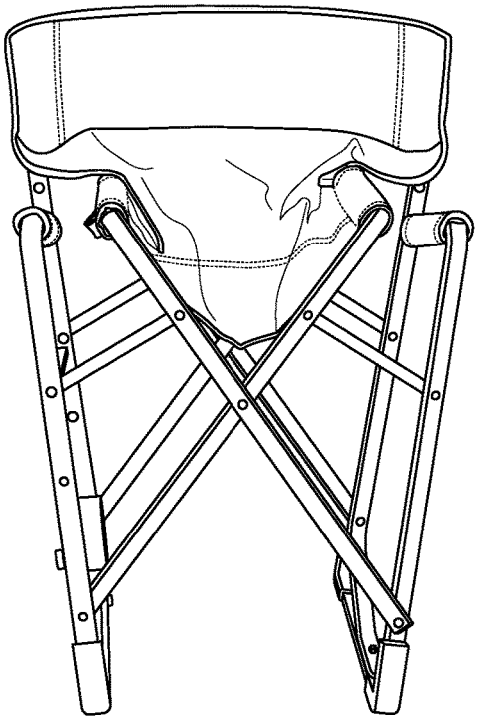
FIG. 18 illustrates the collapsible rocker in a collapsed/folded configuration in accordance with another embodiment of the present invention.
Figure 19A:
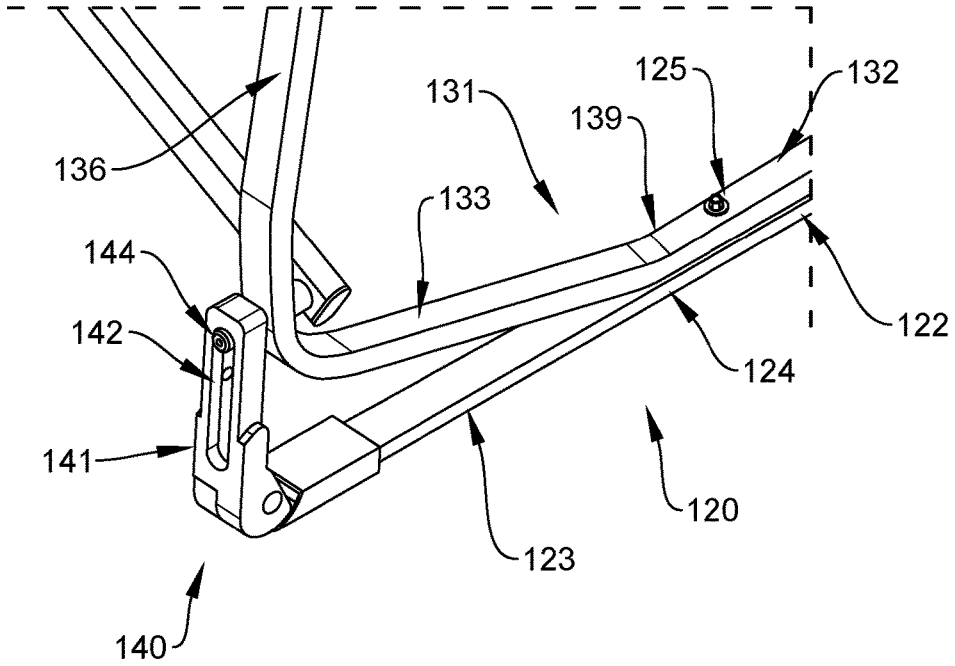
FIGS. 19A to 19D illustrate the relationship of the spring member and the bottom frame portion in a normal upright state of the rocker chair.
Figure 19B:
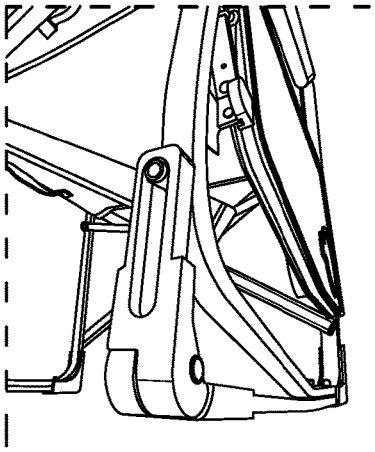
Figure 19C:
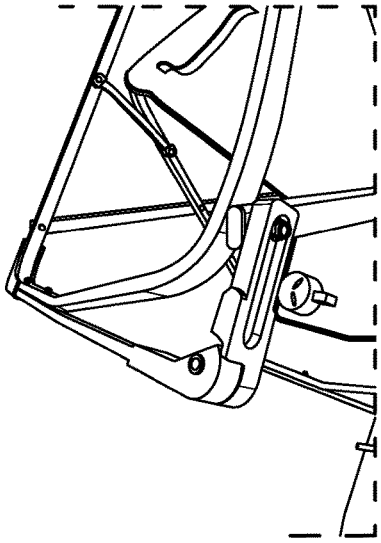
Figure 19D:
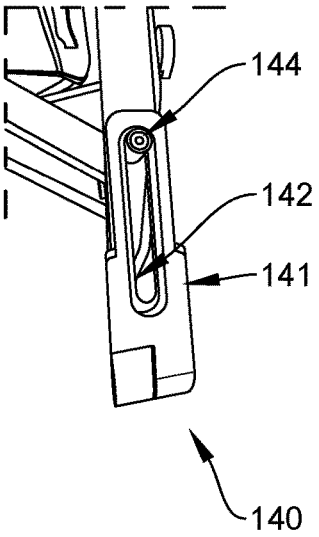

FIGS. 11 to 17 illustrate a collapsible rocker 110 in a fully unfolded extended configuration in accordance with another embodiment of the present invention. FIG. 18 illustrates the collapsible rocker 110 in a collapsed/folded configuration in accordance with another embodiment of the present invention.

As illustrated, the rocker chair comprises a collapsible chair frame 112 structured to convert from a collapsed configuration (FIG. 18) for stowing/transportation, to an extended configuration (FIGS. 11-17) for seating a person, wherein in the collapsed configuration, the frame 112 is folded to collapse the frame 112 into a compact form, wherein in the extended configuration, the frame 112 is unfolded to extend support/seating surfaces (114, 115)) for the person's back and buttock; and a longitudinal spring member 120 including an anchored portion 122 anchored/attached to a horizontal portion 132 of the bottom frame portion 131 of the chair frame 112, and an extended portion 123 extending from the anchored portion 122 with a lateral spacing between the extended portion 123 and an angled portion 133 of the bottom frame portion 131 of the frame 112 in an unbiased state of the spring member 120, wherein the extended portion 123 is bendable towards the angled portion 133 against spring bias of the extended portion 123.

As illustrated, the chair frame 112 supports a flexible seat 113 (e.g., made of a fabric material, such as canvas, polymer/plastic, etc.) defining support/seating surfaces including a seat portion 115 and a seatback portion 114. In one embodiment, the chair frame 112 comprises a pair of side frame members 130 including a first side frame member 130*a* and a second side frame member 130*b*; a pair of connecting members (137*a*, 137*b*) pivotally connecting the first and second side frame members (130*a*, 130*b*), wherein the pair of connecting members (137*a*, 137*b*) can be configured between the extended configuration in which the first and second side frame members (130*a*, 130*b*) are spaced apart, and the collapsed configuration in which the first side frame member 130*a* is brought close to the second side frame member 130*b* to collapse the frame 112.

In one embodiment, the first and second side frame members (130*a*, 130*b*) of the chair frame 112 each includes a bottom frame portion 131 having a horizontal portion 132 and an angled portion 133, a front frame portion 135, a rear frame portion 136, and handle portion 138. Each connecting member (137*a*, 137*b*) comprises a scissor hinge structure pivotally interconnecting between the first and second side frame members (130*a*, 130*b*). The anchored portion 122 of each longitudinal spring member 120 is fixedly attached to the horizontal portion 132 of a bottom frame portion 130, and the extended portion 123 of the longitudinal spring member 120 extends from the anchored portion 122 with a lateral spacing from the angled portion 133 of the bottom frame portion 131 in an unbiased state of the spring member 120. The horizontal portion 132 is towards the front of the chair 110, and the extended portion 122 of the spring member 120 extends towards the rear of the chair 110. In effect, the longitudinal spring member 120 is attached in a cantilevered manner at the flex section 124, with the anchored portion 122 fixedly attached to the horizontal portion 132 of the bottom frame portion 131, and the extended portion 123 extending with a spacing from the angled portion 133 of the bottom frame portion 131, thus cantilevered from the anchored portion 122/horizontal portion 132. The spring member 120 and the attachment of the spring member 120 to the bottom of the frame 112 in this embodiment standing along is essentially similar to the spring member 20 disclosed in the earlier embodiment, except that there is a guide bracket 140 at the distal end of the spring member 120 in this embodiment, which is discussed in greater detail hereinbelow.

FIGS. 19A to 19D illustrate the relationship of the spring member and the bottom frame portion in a normal upright state of the rocker chair. In use, in the unfolded/extended configuration of the chair frame 112, the spring member 120 rests on a support surface for the chair (e.g., ground, a floor, sports field, etc.), with the horizontal portion 132 of the bottom frame portion 131 above the anchored portion 122 of the spring member 120.

FIGS. 20A to 20F illustrate the relationship of the spring member and the bottom frame portion as the rocker chair rocks backwards. A user sitting in the chair can lean backward to place more weight towards the rear of the seat, thereby flexing the extended portion 123 of the spring member 120 with respect to the anchored portion 122 of the spring member 120. More specifically, the joint 139 between the horizontal portion 132 and the angled portion 133 of the bottom frame portion 131. This curved joint 139 at the bottom frame portion 131 rolls over the flex section 124 of the unattached extended portion 123 of the spring member 120. Further, the flex section 124 of the extended portion 123 of the spring member 120 forms a curved structure. The horizontal portion 132 of the bottom frame portion 131 and the attached anchor portion 122 of the spring member 120 together tilt upwards lifting from the ground. As a result, the chair tilts backwards in this configuration. As a result, the extended portion 123 of the spring member 120 flexing towards the angled portion 133 of the bottom frame portion 131 creates a spring bias under the user's weight on the chair 110. As the user shifts his/her weight forward, the spring bias tilts the chair frame 112 from the backward tilt configuration. The user can thus rock the chair 110 by shifting/leaning his/her weight forward and backward to achieve a rocking motion.

In one embodiment, the longitudinal spring member 120 is in the form of a strip or bar having at least a section (i.e., the flex section 124) of material having a firm, relatively stiff, but cyclically flexible/pliant spring characteristic. Suitable materials for the spring member 120 may include fiberglass, wood, laminated wood, plastic, polymer, carbon polymer, carbon fiber, metal alloy, wood and polymer composite, metal and wood composite, etc. In one embodiment, the material for the spring member 120 is preferably fiberglass.

In another embodiment, the flex section 124 extends along substantially entire longitudinal length of the spring member, including the anchored portion 122 and all of the extended portion 123 (i.e., the entire length of the spring member is a substantially uniform, unitary and/or monolithic member, except for the guide bracket attached at the end of the spring member as discussed below).

In one embodiment, the anchored portion 122 of the spring member 120 is securely and fixedly attached to the horizontal portion 132 of the bottom frame portion 131 by bolts and nuts 125. Alternatively, and/or in addition, the anchored portion 122 may be fixedly attached to the horizontal portion 132 by rivets, screws, clamps, epoxy, bonding, welding, brazing, and other means of attachment, depending on the material of the spring member 120.

In the embodiment illustrated in FIGS. 11-20, the end of the spring member is provided with a guide bracket 140 to maintain the lateral (horizontal) position of the extended portion 123 of the spring member 120 relative to the angled portion 133 of the bottom frame portion 131. The guide bracket 141 is pivotally attached to the end of the extended portion 123 of the spring member 120. In an embodiment, the rear frame portion 136 of each of the first and second side frame members (130*a*, 130*b*) of the chair frame 112 extends from the angled portion 133 of the bottom frame portion 131 towards the seatback 114 of the chair 110, and the guide bracket 140 is slidably coupled to the bottom end of the rear frame portion 136. In the illustrated embodiment, the guide bracket 140 has an upwardly extending guide portion 141 having a vertical slot 142, through which a guide pin 144 (e.g., in the form of an extending bolt) extending at the bottom end of the rear frame portion 136 is slidably coupled.

Figure 20A:
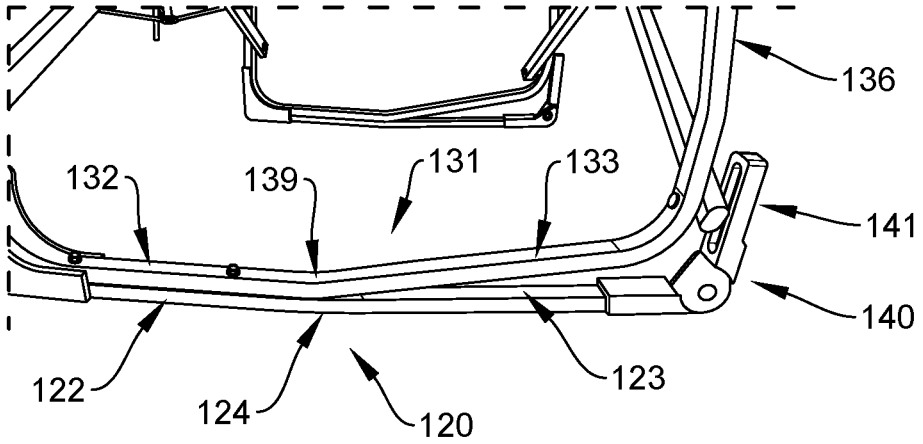
FIGS. 20A to 20F illustrate the relationship of the spring member and the bottom frame portion as the rocker chair rocks backwards.
Figure 20B:
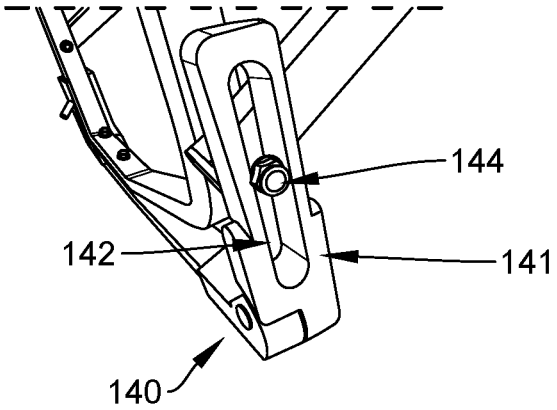
Figure 20C:
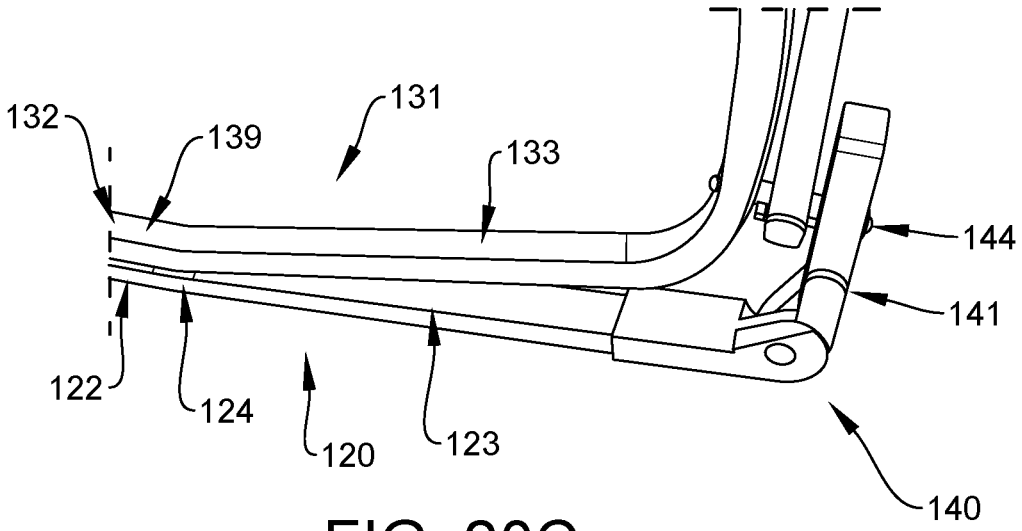

FIGS. 20A-20C illustrate the state in which the chair is rocked backwards halfway. The angled portion 133 moved to an extent closer to the extended portion 123 of the spring member 120.

Figure 20D:
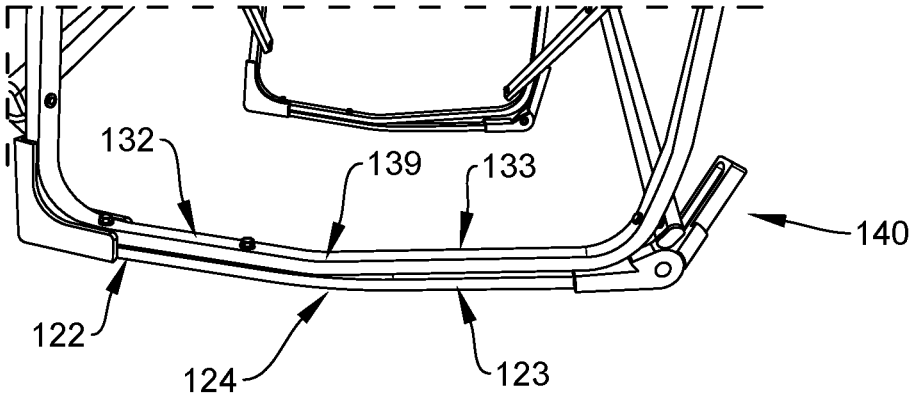
Figure 20E:
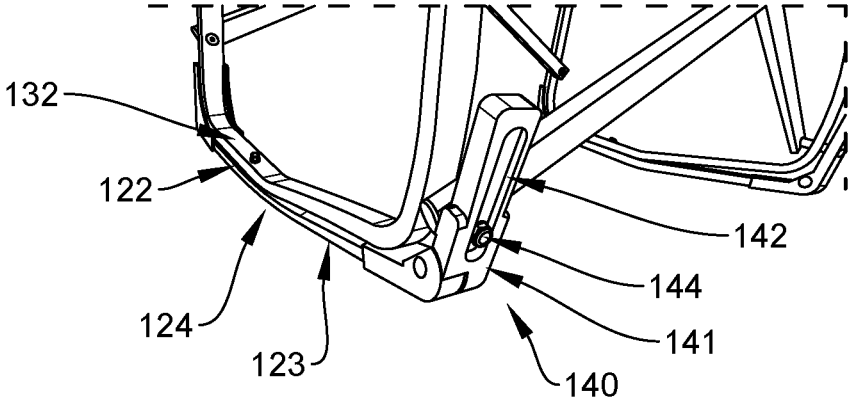
Figure 20F:
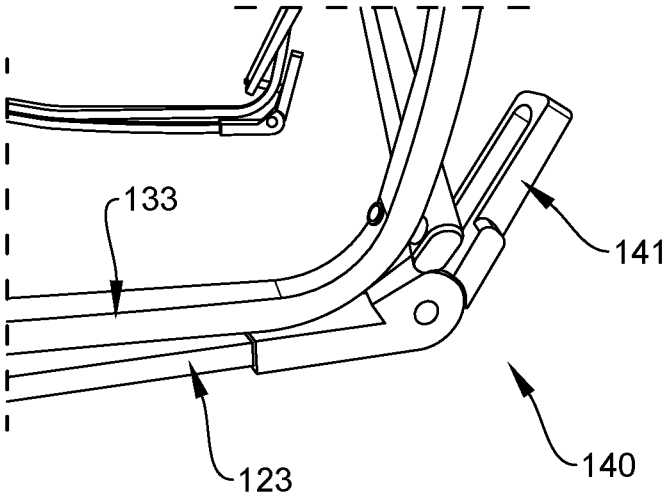
Figure 21:
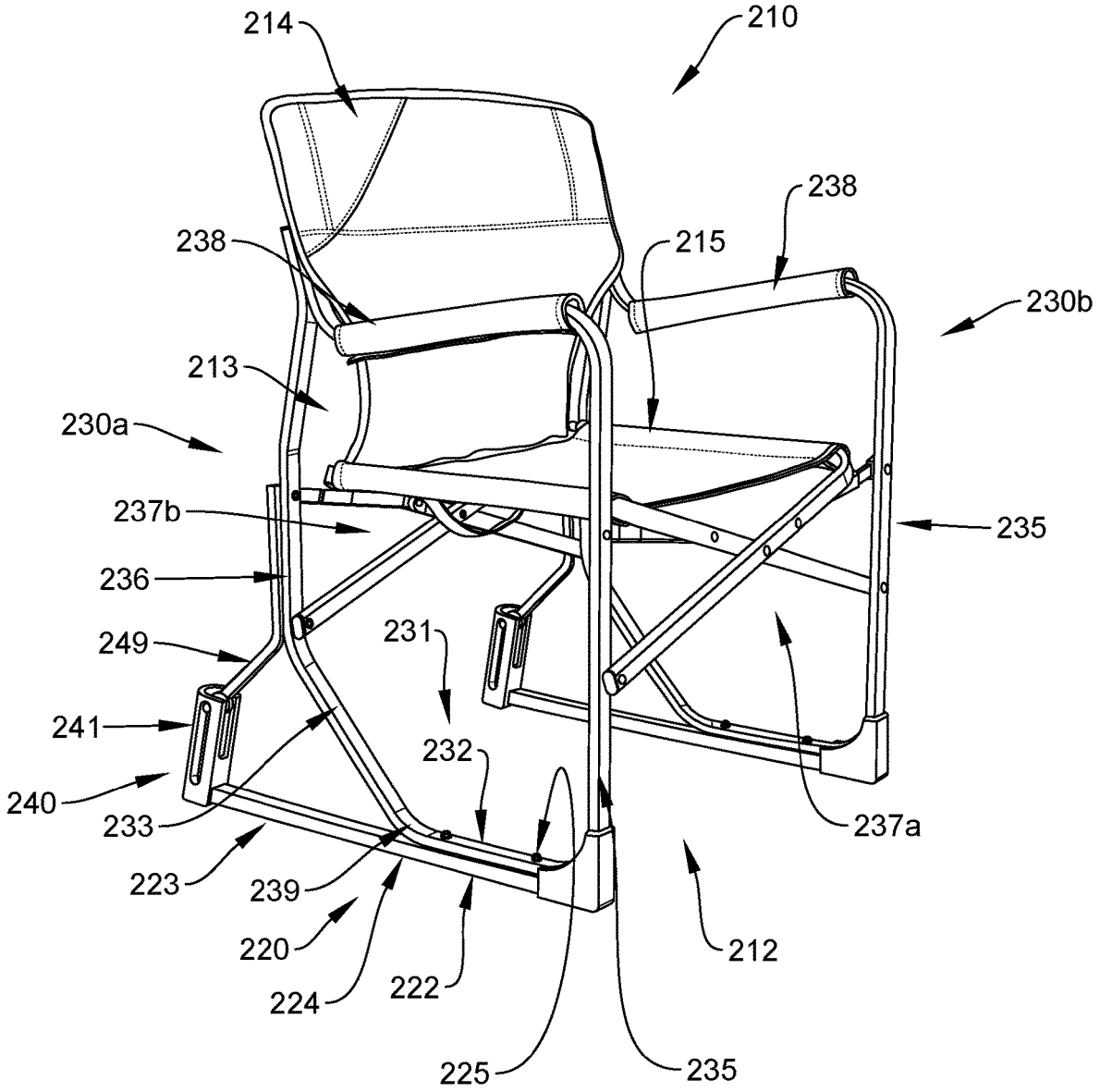
FIGS. 21 to 27 illustrate a collapsible rocker in a fully unfolded extended configuration in accordance with a further embodiment of the present invention.
Figure 22:
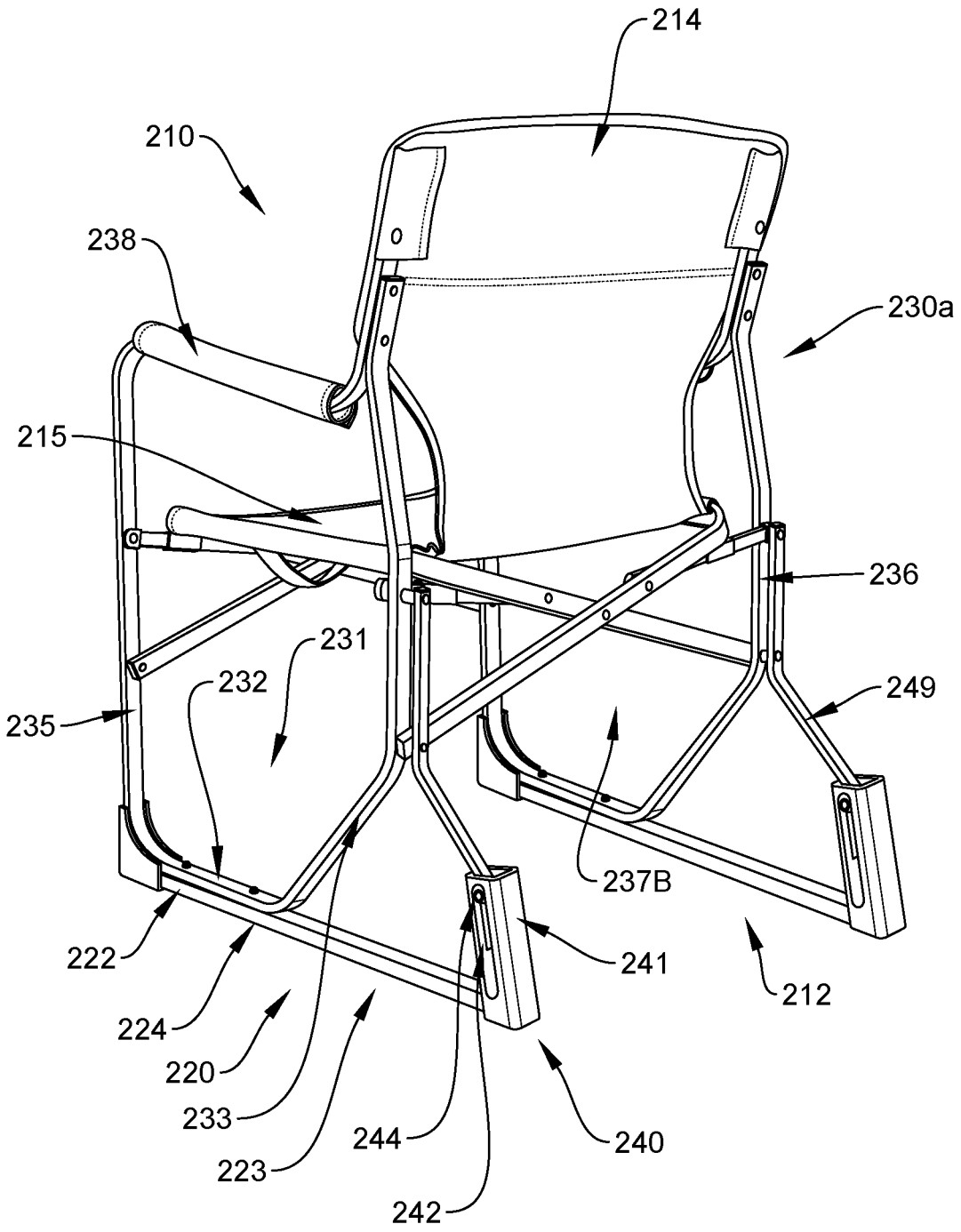
Figure 23:
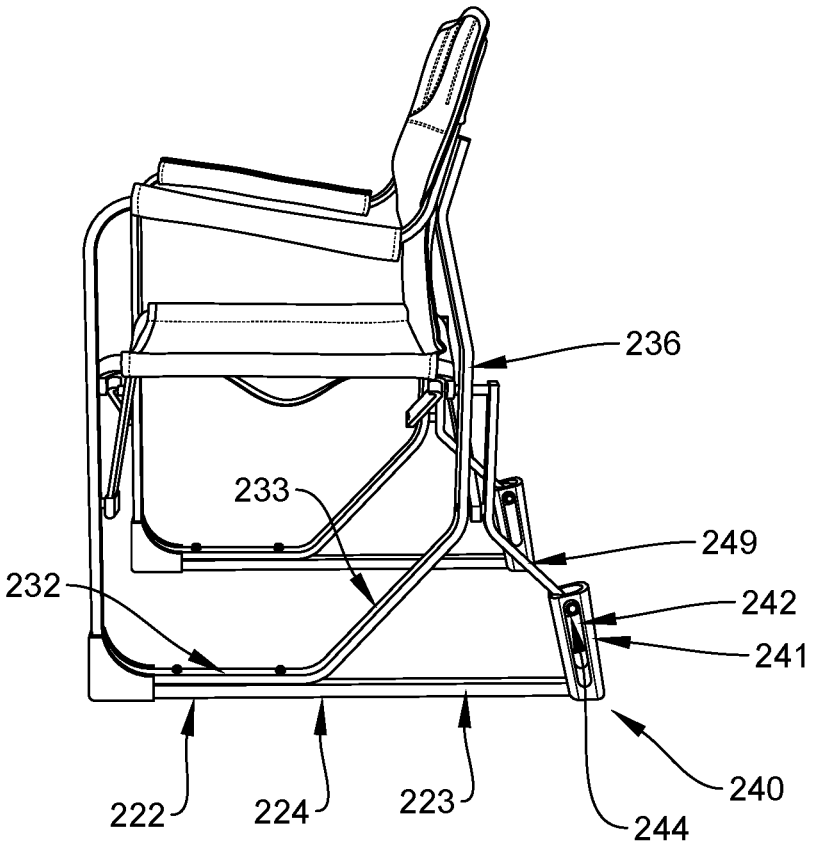
Figure 24:
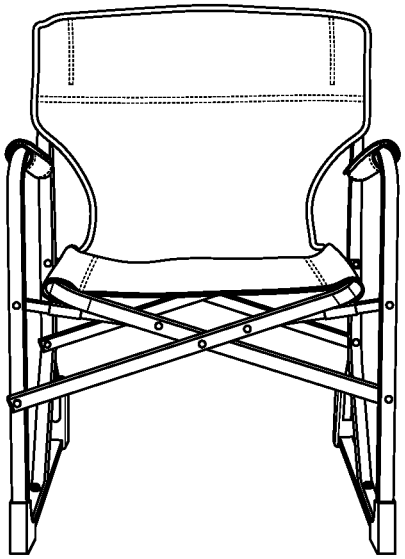
Figure 25:
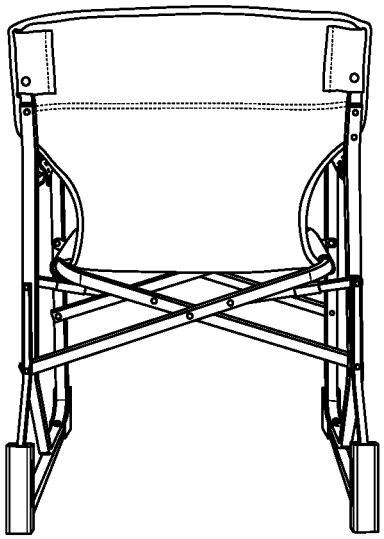
Figure 26:
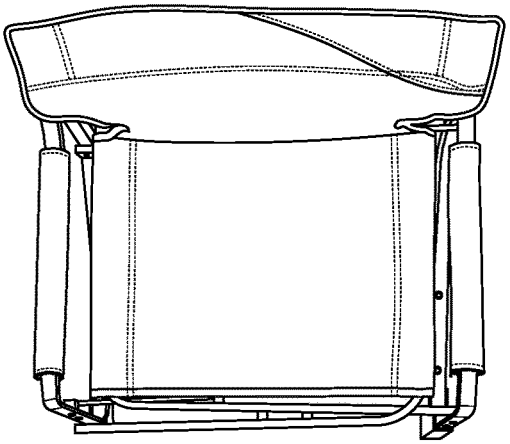
Figure 27:
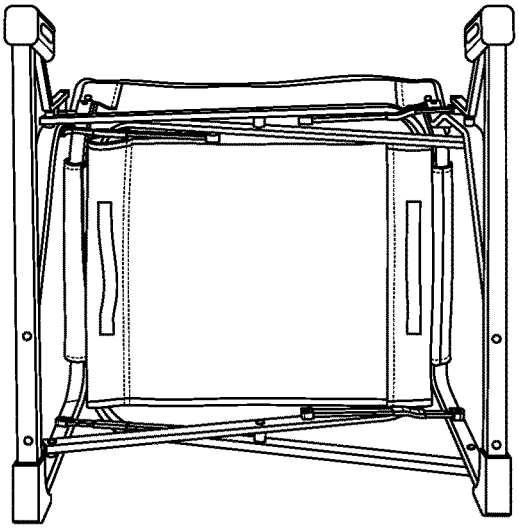

FIGS. 20D-20F illustrate the state in which the chair is rocked backwards to the full extent. The angled portion 133 moved to an extent to touch the extended portion 123 of the spring member 120.

Embodiment C

Figure 28:
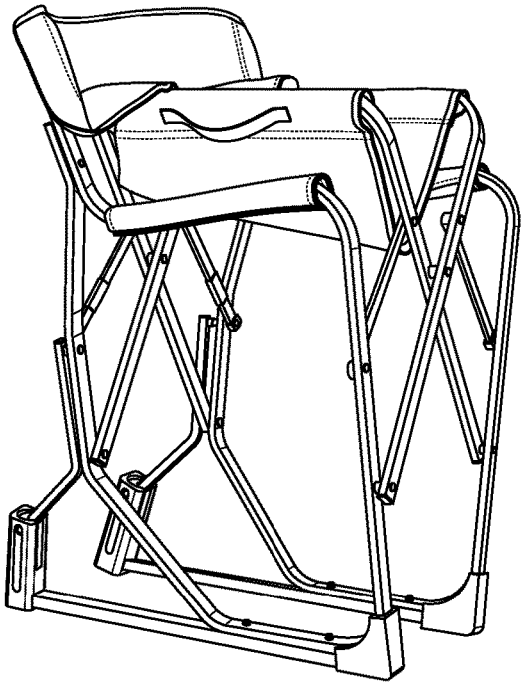
FIG. 28 illustrates the collapsible rocker in a collapsed/folded configuration in accordance with a further embodiment of the present invention.

FIGS. 21 to 27 illustrate a collapsible rocker 210 in a fully unfolded extended configuration in accordance with another embodiment of the present invention. FIG. 28 illustrates the collapsible rocker 210 in a collapsed/folded configuration in accordance with another embodiment of the present invention.

As illustrated, the rocker chair comprises a collapsible chair frame 212 structured to convert from a collapsed configuration (FIG. 28) for stowing/transportation, to an extended configuration (FIGS. 21-27) for seating a person, wherein in the collapsed configuration, the frame 212 is folded to collapse the frame 212 into a compact form, wherein in the extended configuration, the frame 212 is unfolded to extend support/seating surfaces (214, 215)) for the person's back and buttock; and a longitudinal spring member 220 including an anchored portion 222 anchored/attached to a horizontal portion 232 of the bottom frame portion 231 of the chair frame 212, and an extended portion 223 extending from the anchored portion 222 with a lateral spacing between the extended portion 223 and an angled portion 233 of the bottom frame portion 231 of the frame 212 in an unbiased state of the spring member, wherein the extended portion 223 is bendable towards the angled portion 233 against spring bias of the extended portion 223.

As illustrated, the chair frame 212 supports a flexible seat 213 (e.g., made of a fabric material, such as canvas, polymer/plastic, etc.) defining support/seating surfaces including a seat portion 215 and a seatback portion 214. In one embodiment, the chair frame 212 comprises a pair of side frame members 230 including a first side frame member 230*a* and a second side frame member 230*b*; a pair of connecting members (237*a*, 237*b*) pivotally connecting the first and second side frame members (230*a*, 230*b*), wherein the pair of connecting members (237*a*, 237*b*) can be configured between the extended configuration in which the first and second side frame members (230*a*, 230*b*) are spaced apart, and the collapsed configuration in which the first side frame member 230*a* is brought close to the second side frame member 230*b* to collapse the frame 212.

In one embodiment, the first and second side frame members (230*a*, 230*b*) of the chair frame 212 each includes a bottom frame portion 231 having a horizontal portion 232 and an angled portion 233, a front frame portion 235, a rear frame portion 236, and handle portion 238. In this embodiment, the angled portion 233 makes a larger angle to the horizontal portion 232, as compared to the previous embodiments. In this embodiment, for example, the angled portion 233 makes an angle of 30 to 50 degrees, preferably 45 degrees, to the horizontal portion 232. Each connecting member (237*a*, 237*b*) comprises a scissor hinge structure pivotally interconnecting between the first and second side frame members (230*a*, 230*b*). The anchored portion 222 of each longitudinal spring member 220 is fixedly attached to the horizontal portion 232 of a bottom frame portion 230, and the extended portion 223 of the longitudinal spring member 220 extends from the anchored portion 222 with a lateral spacing from the angled portion 233 of the bottom frame portion 231 in an unbiased state of the spring member 220. The horizontal portion 232 is towards the front of the chair 210, and the extended portion 222 of the spring member 220 extends towards the rear of the chair 210. In effect, the longitudinal spring member 220 is attached in a cantilevered manner at the flex section 224, with the anchored portion 222 fixedly attached to the horizontal portion 232 of the bottom frame portion 231, and the extended portion 223 extending with a spacing from the angled portion 233 of the bottom frame portion 231, thus cantilevered from the anchored portion 222/horizontal portion 232. The spring member 220 and the attachment of the spring member 220 to the bottom of the frame 212 in this embodiment standing along is essentially similar to the spring member 20 and the spring member 120 disclosed in the earlier embodiments, except for the guide bracket attached to the distal end of the spring member 220 not found in the first Embodiment A discussing above, and the different guide bracket 240 at the distal end of the spring member 220 in this embodiment compared to the preceding embodiment in FIGS. 11-20, which is discussed in greater detail hereinbelow.

Figure 29A:
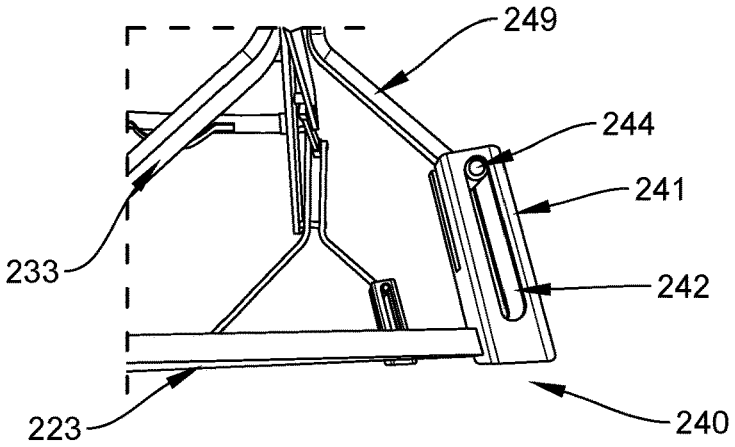
FIGS. 29A to 29C illustrate the relationship of the spring member and the bottom frame portion in a normal upright state of the rocker chair.
Figure 29B:
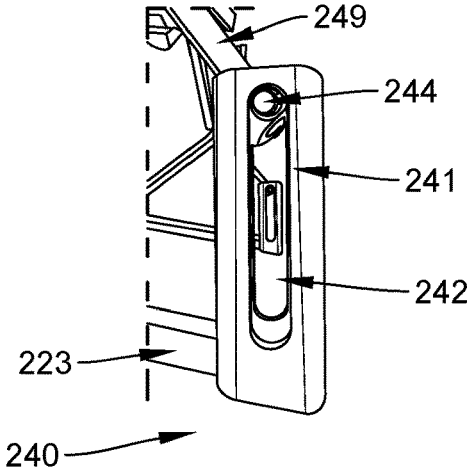
Figure 29C:
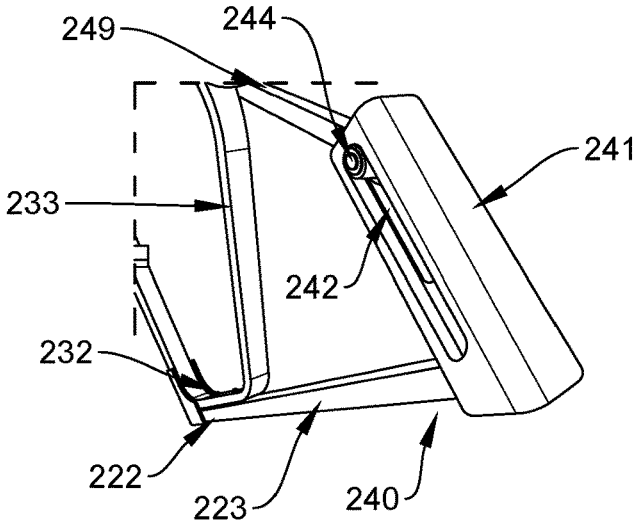

FIGS. 29A to 29C illustrate the relationship of the spring member and the bottom frame portion in a normal upright state of the rocker chair. In use, in the unfolded/extended configuration of the chair frame 212, the spring member 220 rests on a support surface for the chair (e.g., ground, a floor, sports field, etc.), with the horizontal portion 232 of the bottom frame portion 231 above the anchored portion 222 of the spring member 220.

Figure 30A:
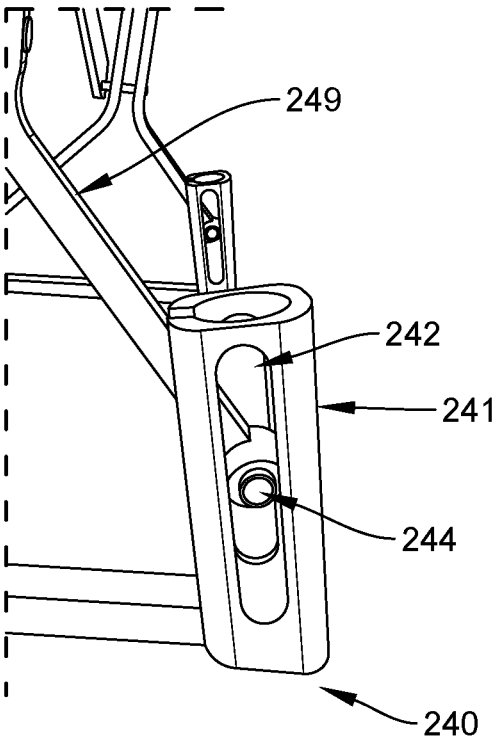
FIGS. 30A and 30B illustrate the relationship of the spring member and the bottom frame portion as the rocker chair rocks backwards.
Figure 30B:
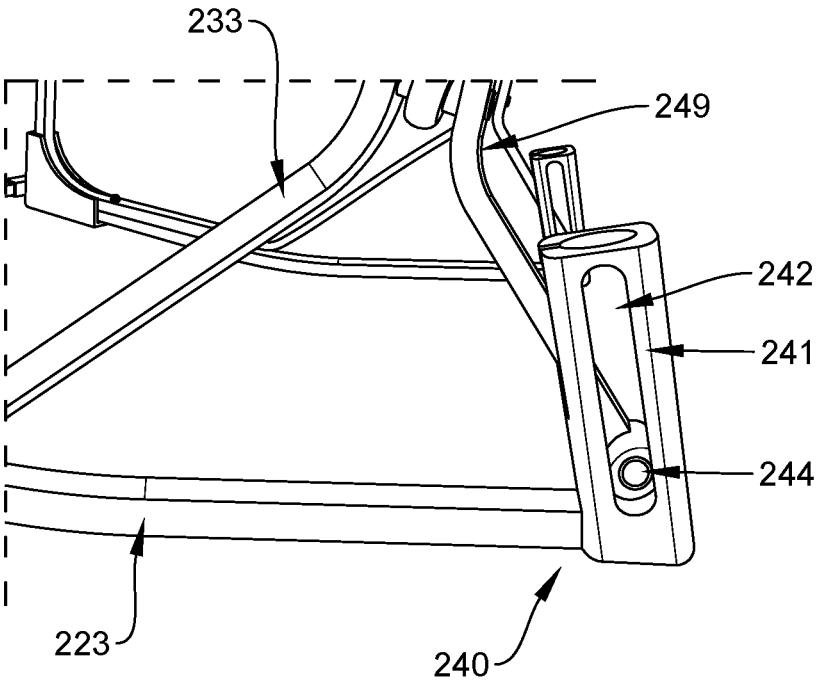

FIGS. 30A and 30B illustrate the relationship of the spring member and the bottom frame portion as the rocker chair rocks backwards. A user sitting in the chair can lean backward to place more weight towards the rear of the seat, thereby flexing the extended portion 223 of the spring member 220 with respect to the anchored portion 222 of the spring member 220. More specifically, the joint 239 between the horizontal portion 232 and the angled portion 233 of the bottom frame portion 231. This curved joint 239 at the bottom frame portion 231 rolls over the flex section 224 of the unattached extended portion 223 of the spring member 220. Further, the flex section 224 of the extended portion 223 of the spring member 220 forms a curved structure. The horizontal portion 232 of the bottom frame portion 231 and the attached anchor portion 222 of the spring member 220 together tilt upwards lifting from the ground. As a result, the chair tilts backwards in this configuration. As a result, the extended portion 223 of the spring member 220 flexing towards the angled portion 233 of the bottom frame portion 231 creates a spring bias under the user's weight on the chair 210. As the user shifts his/her weight forward, the spring bias tilts the chair frame 212 from the backward tilt configuration. The user can thus rock the chair 210 by shifting/leaning his/her weight forward and backward to achieve a rocking motion.

In one embodiment, the longitudinal spring member 220 is in the form of a strip or bar having at least a section (i.e., the flex section 224) of material having a firm, relatively stiff, but cyclically flexible/pliant spring characteristic. Suitable materials for the spring member 220 may include fiberglass, wood, laminated wood, plastic, polymer, carbon polymer, carbon fiber, metal alloy, wood and polymer composite, metal and wood composite, etc. In one embodiment, the material for the spring member 220 is preferably fiberglass.

In another embodiment, the flex section 224 extends along substantially entire longitudinal length of the spring member, including the anchored portion 222 and all of the extended portion 223 (i.e., the entire length of the spring member is a substantially uniform, unitary and/or monolithic member, except for the guide bracket attached at the end of the spring member as discussed below).

In one embodiment, the anchored portion 222 of the spring member 220 is securely and fixedly attached to the horizontal portion 232 of the bottom frame portion 231 by bolts and nuts 225. Alternatively, and/or in addition, the anchored portion 222 may be fixedly attached to the horizontal portion 232 by rivets, screws, clamps, epoxy, bonding, welding, brazing, and other means of attachment, depending on the material of the spring member 220.

In the embodiment illustrated in FIGS. 21-30, the end of the spring member is provided with a guide bracket 140 to maintain the lateral (horizontal) position of the extended portion 223 of the spring member 220 relative to the angled portion 233 of the bottom frame portion 231. The guide bracket 241 is fixedly attached to the end of the extended portion 223 of the spring member 220. The rear frame portion 236 of each of the first and second side frame members (230*a*, 230*b*) of the chair frame 212 extends from the angled portion 233 of the bottom frame portion 231 towards the seatback 214 of the chair 210, and the rear frame portion of each of the first and second side frame members of the chair frame includes a branch portion 249 extending downwards to the end of the extended portion 223 of the spring member 220, and the guide bracket 240 is slidably coupled to the depending end 251 of the branch portion 249, in a similar manner as the previous embodiment (i.e., slot and guide pin coupling). Alternatively, the guide bracket is pivotally attached to the end of the spring member 220.

In the illustrated embodiment, the guide bracket 240 has an upwardly extending guide portion 241 having a vertical slot 242 on the side of the guide portion 241 (as compared to the embodiment in FIGS. 11-20), through which a guide pin 244 (e.g., in the form of a short rod) extending at the bottom end 251 of the branch portion 249 is slidably coupled.

FIG. 30A illustrates the state in which the chair is rocked backwards halfway. The angled portion 233 moved to an extent closer to the extended portion 223 of the spring member 220.

FIG. 30B illustrates the state in which the chair is rocked backwards to the full extent. In this embodiment, given the angled portion 233 makes a larger angle to the horizontal, the angled portion 233 does not move to an extent to touch the extended portion 223 of the spring member 220.

The inventive rocker chair may be tailored for use for specific applications and uses. For example, the rocker chair may be in the form of a beach chair, patio chair, lounge chair, or chairs for other applications and uses. The materials for various components of the rocker chair may be chosen for the intended application. For example, for beach application, the seating surfaces may be made of a synthetic (e.g., plastic) and/or canvas and/or cloth material, the frame portions may be made of metal and/or hard plastic.

While the invention has been particularly shown and described with reference to the preferred embodiments, it will be understood by those skilled in the art that various changes in form and detail may be made without departing from the spirit, scope, and teaching of the invention. Accordingly, the disclosed invention is to be considered merely as illustrative and limited in scope only as specified in the appended claims.

The invention claimed is:

1. A rocker chair, comprising:

a frame comprising a rigid frame portion; and a horizontal longitudinal spring member extending from the rigid frame portion, substantially parallel to and at or near a support surface on which the rocker chair is supported for rocking motion, wherein the spring member is attached to the rigid frame portion, wherein the spring member comprises at least a flex section of a material having a pliant spring characteristic, wherein the spring member is free to flex against spring bias of the flex section upward away from the support surface.

2. The rocker chair of claim 1, wherein the spring member is bendable against spring bias of the flex section to tilt the rigid frame portion and the spring member together upwards lifting from the support surface.

3. The rocker chair of claim 2, wherein the spring member is bendable against spring bias of the flex section upward away from the support surface in a cantilevered manner.

4. The rocker chair of claim 1, wherein a curved member of the frame rolls over the flex section of the spring member to bend the flex section to form a curved configuration, and the spring member and the rigid frame portion together tilts upwards lifting from the support surface.

5. The rocker chair of claim 4, whereby the flex section is cantilevered from said curved member of the frame.

6. The rocker chair of claim 4, wherein the frame comprises:

a pair of side frame members including a first side frame member and a second side frame member; and a connecting frame connecting the first and second side frame members, wherein the spring member comprises first and second spring members, extending from the first and second side frame members, respectively.

7. The rocker chair of claim 6, wherein the first and second side frame members each comprises the rigid frame portion and the curved portion, wherein the spring member is attached to the rigid frame portion of the respective first and second side frame members, and the flex section of the spring member extends from the rigid frame portion of the respective first and second side frame members, and wherein the respective spring member is bendable at the flex section against spring bias of the flex section with the curved member rolling over the flex section.

8. The rocker chair of claim 1, wherein the spring member comprises an attached portion attached to the rigid frame portion, and an extended portion extending from the attached portion, wherein the extended portion comprises the flex section, wherein the extended portion is free to flex against spring bias of the flex section of the extended portion, and wherein the extended portion is bendable at the flex section upward away from the support surface against spring bias of the extended portion.

9. The rocker chair of claim 8, wherein the extended portion is bendable to tilt the rigid frame portion and the attached portion of the spring member together upwards lifting from the support surface.

10. The rocker chair of claim 8, wherein the rigid frame portion comprises a bottom frame portion including a horizontal portion and an angled portion, wherein the attached portion of the spring member comprises an anchored portion fixedly attached to the horizontal portion of the respective bottom frame portion of the first and second side frame members, and the extended portion of the spring member extends from the anchored portion with a lateral spacing from the angled portion of the bottom frame portion in an unbiased state of the spring member.

11. The rocker chair of claim 10, wherein the horizontal portion is located towards a front of the rocker chair, and the extended portion of the spring member extends towards a rear of the rocker chair.

12. The rocker chair of claim 10, wherein the bottom frame portion includes a curved portion at a joint between the horizontal portion and the angled portion, and wherein when the curved portion rolls over the flex section of the extended portion of the spring member, the flex section bends to form a curved configuration, and the horizontal portion and the attached anchored portion of the spring member together tilts upwards lifting from the support surface.

13. The rocker chair of claim 8, further comprising a guide bracket attached to a distal end of the extended portion of the spring member, wherein the guide bracket is slidably coupled to the frame, and wherein the guide bracket maintains a lateral position of the spring member.

14. The rocker chair of claim 13, wherein the frame further comprises a rear frame portion extending from the angled portion of the bottom frame portion towards a seatback of the chair, and the guide bracket is slidably coupled to a bottom end of the rear frame portion.

15. The rocker chair of claim 14, wherein the guide bracket has an upwardly extending guide portion having a vertical slot, through which a guide pin extending at the bottom end of the rear frame portion is slidably coupled.

16. The rocker chair of claim 13, wherein the guide bracket is pivotally attached or fixedly attached to the distal end of the extended portion of the spring member.

17. The rocker chair of claim 1, wherein the rigid frame portion is made of a material that is different from the material of the flex section, and wherein the material of the rigid frame portion is relatively rigid compared to the material of the flex section.

18. The rocker chair of claim 1, wherein the material of the flex section of the spring member is one of fiberglass, wood, laminated wood, plastic, polymer, carbon polymer, carbon fiber, metal alloy, wood and polymer composite, metal and wood composite.

19. The rocker chair of claim 1, wherein the frame is structured to convert from a collapsed configuration for stowing to an extended configuration for seating a person, wherein in the collapsed configuration, the frame is folded to collapse the frame into a compact form, wherein in the extended configuration, the frame is unfolded to support seat defining support surfaces for the person's back and buttock.

20. The rocker chair of claim 1, further comprising flexible seat defining support surfaces, which comprises surfaces forming a seat portion and a seatback portion.

* * * * *